US007944092B2

(12) United States Patent
Ueno

(10) Patent No.: US 7,944,092 B2
(45) Date of Patent: May 17, 2011

(54) DEVICE HAVING MALFUNCTION PREVENTING CIRCUIT

(75) Inventor: Toshiyuki Ueno, Sunto-gun (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 220 days.

(21) Appl. No.: 12/415,753

(22) Filed: Mar. 31, 2009

(65) Prior Publication Data

US 2009/0251977 A1 Oct. 8, 2009

Related U.S. Application Data

(60) Provisional application No. 61/041,906, filed on Apr. 2, 2008.

(51) Int. Cl.
*H01H 9/54* (2006.01)

(52) U.S. Cl. ..... 307/140

(58) Field of Classification Search ..... 307/140
See application file for complete search history.

(56) References Cited

U.S. PATENT DOCUMENTS

2002/0153899 A1 * 10/2002 Watanabe et al. ..... 324/537
* cited by examiner

*Primary Examiner* — Robert L. Deberadinis
(74) *Attorney, Agent, or Firm* — Patterson & Sheridan, LLP

(57) ABSTRACT

A fixing device fixes a toner image on a recording medium. The fixing device includes a heat source that converts electric power into heat and a fixing member that gives the heat generated by the heat source to the recording medium on which the toner image is formed. The fixing device includes a safety circuit that forcibly interrupts voltage supplied from a power supply to the heat source if the temperature in the device detected by a temperature detection sensor exceeds reference temperature. The fixing device has a malfunction preventing circuit that stops the operation of the safety circuit in order to prevent the voltage supplied to the heat source from being forcibly interrupted when the voltage of the power supply supplied to the heat source is unstable.

20 Claims, 6 Drawing Sheets

DEVICE HAVING MALFUNCTION PREVENTING CIRCUIT

CROSS-REFERENCE TO RELATED APPLICATION

This application claims the benefit of U.S. Provisional Application No. 61/041,906, filed Apr. 2, 2008.

TECHNICAL FIELD

The present invention relates to, for example, operation control for a heating device such as a fixing device or a memory control device used in an image forming apparatus.

BACKGROUND

A digital multifunction peripheral includes, for example, an engine control unit, a laser unit, a developing device, and a fixing device. The engine control unit controls the laser unit, the developing device, and the fixing device. The laser unit forms an electrostatic latent image. The developing device develops the electrostatic latent image. The fixing device fixes the developed image on a sheet. The fixing device presses and heats the sheet in order to fix the image on the sheet. The fixing device may be heated to temperature equal to or higher than 200° C. The engine control unit has a safety function for preventing the temperature of the fixing device from rising to abnormally high temperature even when runaway of a control program or a failure of components occurs. The safety function of the fixing device is established by, for example, an electronic circuit (a safety circuit) in order to realize the safety function without the intervention of software. The safety circuit monitors the temperature in the fixing device using a thermistor or a thermopile.

However, in the digital multifunction peripheral, power supply voltage may be unstable, for example, immediately after a power supply is turned on or immediately after the power supply is turned off. When the power supply voltage is unstable, it may be difficult for the safety circuit to stably operate. When the power supply voltage is unstable, two problems explained below are likely to occur in the safety circuit.

A first problem is that a relation between reference voltage and output voltage of the thermopile or the like is likely to be unstable. The reference voltage is often generated by resistance-dividing the power supply voltage. This means that, when the power supply voltage becomes unstable, the reference voltage also becomes unstable. A temperature detection module such as the thermopile requires time of about several tens milliseconds to several seconds for stabilization of an output value (a return value) of a sensor immediately after the power supply is turned on and has a function of retaining the output value in order to reduce the influence due to a change in the power supply voltage. In short, when the power supply is unstable, a magnitude relation between the reference voltage susceptible to a change in the power supply voltage and detection voltage robust against a change in the power supply voltage tends to be opposite to an actual magnitude relation. This means that the safety circuit is liable to malfunction. It is also conceivable to generate the reference voltage using a Zener diode or the like. However, since there is a problem in practice in an error range or the like of the Zener diode itself, the Zener diode is not suitable as an element for generating the reference voltage.

A second problem is that plural power supply systems are provided in the safety circuit. A comparator IC (a comparator) can perform accurate comparison only at a voltage level substantially lower than power supply voltage for the IC. Therefore, the comparator cannot use power supply voltage same as that for the thermopile as driving voltage. For example, when the thermopile is 5V-driven, the comparator IC needs to be driven at voltage equal to or higher than 6.5V (e.g., 12V). In this case, if 12V (the driving voltage for the comparator) falls earlier at a stage when 5V (the driving voltage for the safety circuit) still sufficiently remains after the power supply is turned off, since it is not guaranteed that output of the comparator is normal, malfunction tends to be caused.

SUMMARY

According to an aspect of the present invention, there is provided a heating device including: a heat source that converts electric power into heat; a power supply control circuit that supplies voltage from a power supply to the heat source; a sensor that detects ambient temperature of the heat source; a safety circuit that forcibly interrupts the voltage supplied to the heat source by the power supply control circuit if the temperature detected by the sensor exceeds reference temperature; and a malfunction preventing circuit that stops the operation of the safety circuit when voltage supplied to the safety circuit is unstable.

According to another aspect of the present invention, there is provided a fixing device that fixes a toner image on a recording medium, the fixing device including: a heat source that converts electric power into heat; a fixing member that fixes the toner image on the recording medium with the heat generated by the heat source; a power supply control circuit that supplies voltage from a power supply to the heat source; a sensor that detects the temperature in the fixing device; a safety circuit that forcibly interrupts the voltage supplied to the heat source by the power supply control circuit if the temperature detected by the sensor exceeds reference temperature; and a malfunction preventing circuit that stops the operation of the safety circuit when voltage supplied to the safety circuit is unstable.

According to still another aspect of the present invention, there is provided a memory control device including: a volatile memory driven by voltage supplied from a power supply; a battery for retaining data to be stored in the volatile memory; a control unit that writes data in the volatile memory driven by the voltage supplied from the power supply; and a malfunction preventing circuit that outputs an disable signal for inhibiting the writing of the data in the volatile memory when the driving voltage supplied to the volatile memory is unstable.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

FIG. 4 is a graph of a relation between the reference voltage value and an output value of the thermopile before and after the power supply for the printer is turned on;

DETAILED DESCRIPTION

An embodiment of the present invention is explained below with reference to the accompanying drawings.

Figure 1:
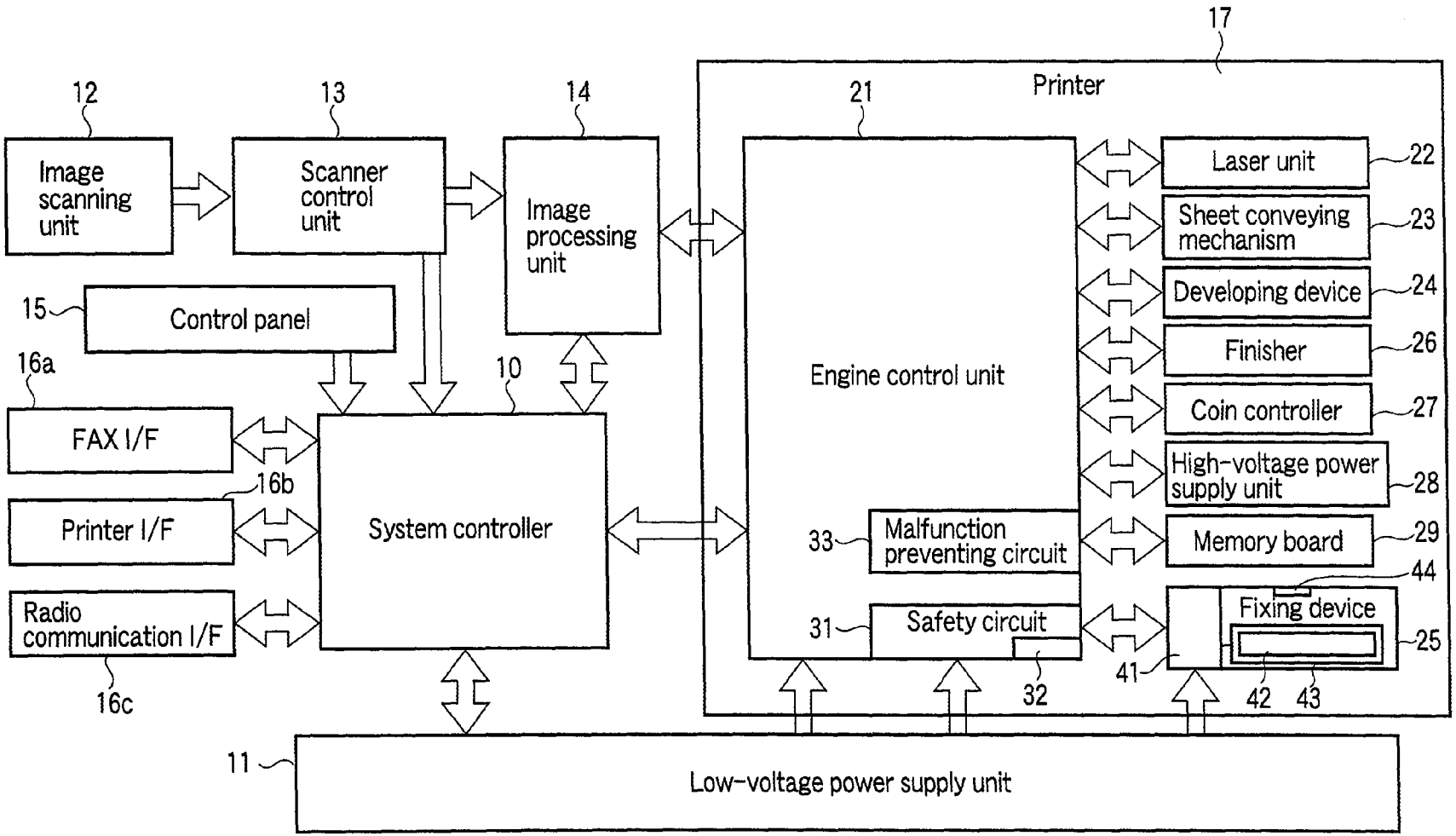
FIG. 1 is a block diagram of a configuration example of a digital multifunction peripheral including a fixing device.

FIG. 1 is a block diagram of a configuration example of a digital multifunction peripheral 1 including a fixing device.

As shown in FIG. 1, the digital multifunction peripheral 1 includes a system controller 10, a low-voltage power supply unit 11, an image scanning unit 12, a scanner control unit 13, an image processing unit 14, a control panel 15, a facsimile interface (I/F) 16*a*, a printer interface (I/F) 16*b*, a radio communication interface (I/F) 16*c*, and a printer 17.

The system controller 10 manages the control of the entire digital multifunction peripheral 1. The system controller 10 includes an arithmetic unit, a memory, and an internal interface. In the system controller 10, for example, the arithmetic unit such as a CPU executes a control program to thereby realize control of the respective units and various processing functions. The system controller 10 includes, as various memories, a ROM, a RAM, a page memory, and a hard disk drive. The ROM stores the control program or control data. The RAM temporarily stores various parameters, work data, and the like. The page memory stores image data for one page. The hard disk drive stores data such as compressed image data.

The low-voltage power supply unit 11 supplies low power supply voltage to the respective units in the digital multifunction peripheral 1. For example, the low-voltage power supply unit 11 supplies the power supply voltage not only to the system controller 10 but also to an engine control unit 21, a safety circuit 31, a fixing device 25, and the like in the printer 17 explained later.

The image scanning unit 12 optically scans an image of an original document to thereby convert the image of the original document into image data. The image scanning unit 12 includes, for example, a CCD sensor as a photoelectric conversion element, a CCD driver, a signal processing circuit, a scan motor, and an exposure lamp. The CCD sensor converts reflected light from the original document into an electric signal. The CCD deriver drives the CCD sensor. The signal processing circuit processes an output signal of the CCD sensor. The scan motor gives driving force for scanning the entire original document to a carriage (not shown) mounted with the CCD sensor. The exposure lamp exposes a scan surface of the original document. The scanner control unit 13 controls the image scanning unit 12. In other words, the scanner control unit 13 controls scan processing for the original document by controlling the respective units in the image scanning unit 12.

The image processing unit 14 converts image data into desired image data. For example, the image processing unit 14 converts image data scanned by the image scanning unit 12 into image data for print. Further, the image processing unit 14 converts image data input by the various interfaces into image data for print.

The control panel 15 is a user interface for the digital multifunction peripheral 1. The control panel 15 functions as an operation unit with which a user inputs an operation instruction. The control panel 15 also functions as a display unit that provides the user with various guides. The control panel 15 is connected to the system controller 10. The control panel 15 includes, for example, a liquid crystal display device incorporating a touch panel. In this case, the control panel 15 displays various operation keys (icons) that can be selected by the touch panel.

The facsimile interface 16*a* is an interface for performing facsimile communication. The printer interface 16*b* is an interface for acquiring print data. For example, when the digital multifunction peripheral 1 also functions as a network printer, the printer interface 16*b* includes a network interface such as a LAN interface. The radio communication interface 16*c* is an interface for performing radio communication.

The printer 17 prints an image on a sheet. In this embodiment, the printer 17 is a printer of an electrophotographic system. The printer 17 includes, as shown in FIG. 1, the engine control unit 21, a laser unit 22, a sheet conveying mechanism 23, a developing device 24, the fixing device 25, a finisher 26, a high-voltage power supply unit 28, a coin controller 27, and a memory board 29.

The engine control unit 21 controls the respective units of the printer 17. For example, the engine control unit 21 controls the respective units of the printer 17 to thereby control a series of processing in a print operation. The engine control unit 21 includes, for example, a CPU and hardware circuits. The CPU executes a control program to thereby realize various kinds of control. The hardware circuits are control circuits specialized for various kinds of operation control. In other words, the engine control unit 21 controls the printer 17 using the CPU that realizes the various kinds of control with software and the control circuit including hardware. For example, the engine control unit 21 includes, as the hardware circuits, the safety circuit 31, a malfunction preventing circuit 32 for the safety circuit 31, and a malfunction preventing circuit 33 for the memory board 29. These circuits are explained in detail later.

The laser unit 22 irradiates a laser beam on a photoconductive drum (not shown) as an image bearing member to form an electrostatic latent image. In other words, the laser unit 22 irradiates a laser beam, light intensity of which is changed according to image data, onto an outer circumferential surface of the photoconductive drum to thereby form an electrostatic latent image, i.e., an image corresponding to the image data on the outer circumferential surface of the photoconductive drum.

The sheet conveying mechanism 23 feeds a sheet as an image formation medium from a not-shown paper feeding tray. The sheet conveying mechanism 23 is a mechanism for conveying the fed sheet in the printer 17.

The developing device 24 supplies a toner to the photoconductive drum, on which the electrostatic latent image is formed by the laser unit 22, to thereby form a toner image on the photoconductive drum. The developing device 24 transfers the toner image formed on the photoconductive drum onto the sheet. The developing device 24 may transfer the toner image onto an intermediate transfer member. In this case, the toner image is transferred from the intermediate transfer member onto the sheet.

The fixing device 25 fixes the toner image on the sheet. The fixing device 25 gives heat to the sheet on which the toner image is transferred. The fixing device 25 also gives pressure to the sheet simultaneously with applying heat thereto. The toner image fixes (adheres) on the sheet heated and pressed by the fixing device 25. A configuration in the fixing device 25 is explained in detail later.

The finisher 26 processes the sheet on which the image is printed. The finisher 26 staples or punches, for example, plural sheets subjected to print processing. The sheet subjected to fixing processing by the fixing device 25 is fed to the finisher 26. The coin controller 27 performs processing corresponding to a coin(s) inserted into a not-shown coil slot. For example, the coin controller 27 outputs a signal indicating possibility of print to the engine control unit 21 according to the inserted coin(s). The high-voltage power supply unit 28 generates high power supply voltage.

The memory board 29 stores various kinds of information in the printer 17. The memory board 29 stores, for example, setting information and log information of the printer 17. The memory board 29 includes a rewritable memory that can retain stored data even if a power supply for the entire digital multifunction peripheral 1 or the entire printer 17 is off. In this embodiment, the memory board 29 includes a volatile memory and a battery as components of the rewritable memory. In this case, the volatile memory includes, for example, an SRAM or a DRAM. The battery supplies a voltage for retaining data stored in the volatile memory even if the power supply for the entire digital multifunction peripheral 1 or the entire printer 17 is off.

A configuration of the fixing device 25 is explained in detail below.

The fixing device 25 includes, as shown in FIG. 1, a power supply control circuit 41, a heat source 42, a fixing member 43, and a temperature detection sensor 44.

The power supply control circuit 41 is a circuit that controls voltage supplied from the low-voltage power supply unit 11. The power supply control circuit 41 includes a hardware circuit. The power supply control circuit 41 turns on and off a power supply for the fixing device 25 according to a control signal from the engine control unit 21. The safety circuit 31 in the engine control unit 21 is connected to the power supply control circuit 41.

The heat source 42 converts electric power into heat. The heat source 42 generates heat with voltage supplied from the power supply. The heat source 42 is connected to the power supply control circuit 41 that controls the voltage supply from the power supply. The heat source 42 is, for example, a fixing lamp as a heat generating member or a coil for induction heating.

The fixing member 43 is heated by the heat source 42. The fixing member 43 heats the sheet with the heat from the heat source 42. The fixing member 43 heats the sheet with pressure applied to the sheet. The fixing member 43 heated to fixing temperature comes into contact with the sheet, on which the toner image is transferred, with pressure applied to the sheet. The toner image adheres to the sheet with which the fixing member 43 having the fixing temperature is in contact. When the heat source 42 is the heat generating member such as the fixing lamp, the fixing member 43 accumulates the heat from the heat source 42 to be heated to high temperature (the fixing temperature). In this case, the fixing member 43 is formed as a fixing roller incorporating the fixing lamp as the heat source 42. When the heat source 42 is the coil for induction heating, the fixing member 43 is heated to high temperature (the fixing temperature) by an induction current generated by the coil as the heat source 42. In this case, the fixing member 43 is formed as a fixing roller incorporating the coil. The fixing roller is made of a member in which an induction current is generated by the coil.

The temperature detection sensor 44 detects the temperature in the fixing device 25. The temperature detection sensor 44 is set to detect the ambient temperature of the fixing member 43. The temperature detection sensor 44 outputs a voltage value corresponding to the detected temperature. The temperature detection sensor 44 is connected to the safety circuit 31. The temperature detection sensor 44 is, for example, a thermopile or a thermistor. In the explanation of this embodiment, it is assumed that the thermopile is used as the temperature detection sensor 44.

The thermopile outputs a voltage value corresponding to the detected temperature. The thermopile is driven at power supply voltage (e.g., 5V). The thermopile has time of about several tens milliseconds to several seconds in order to stabilize an output value. The thermopile has a characteristic that the thermopile retains the output value not to be sensitively affected by a very small change of the power supply voltage.

Power supply control for the fixing device 25 is explained below.

Figure 2:
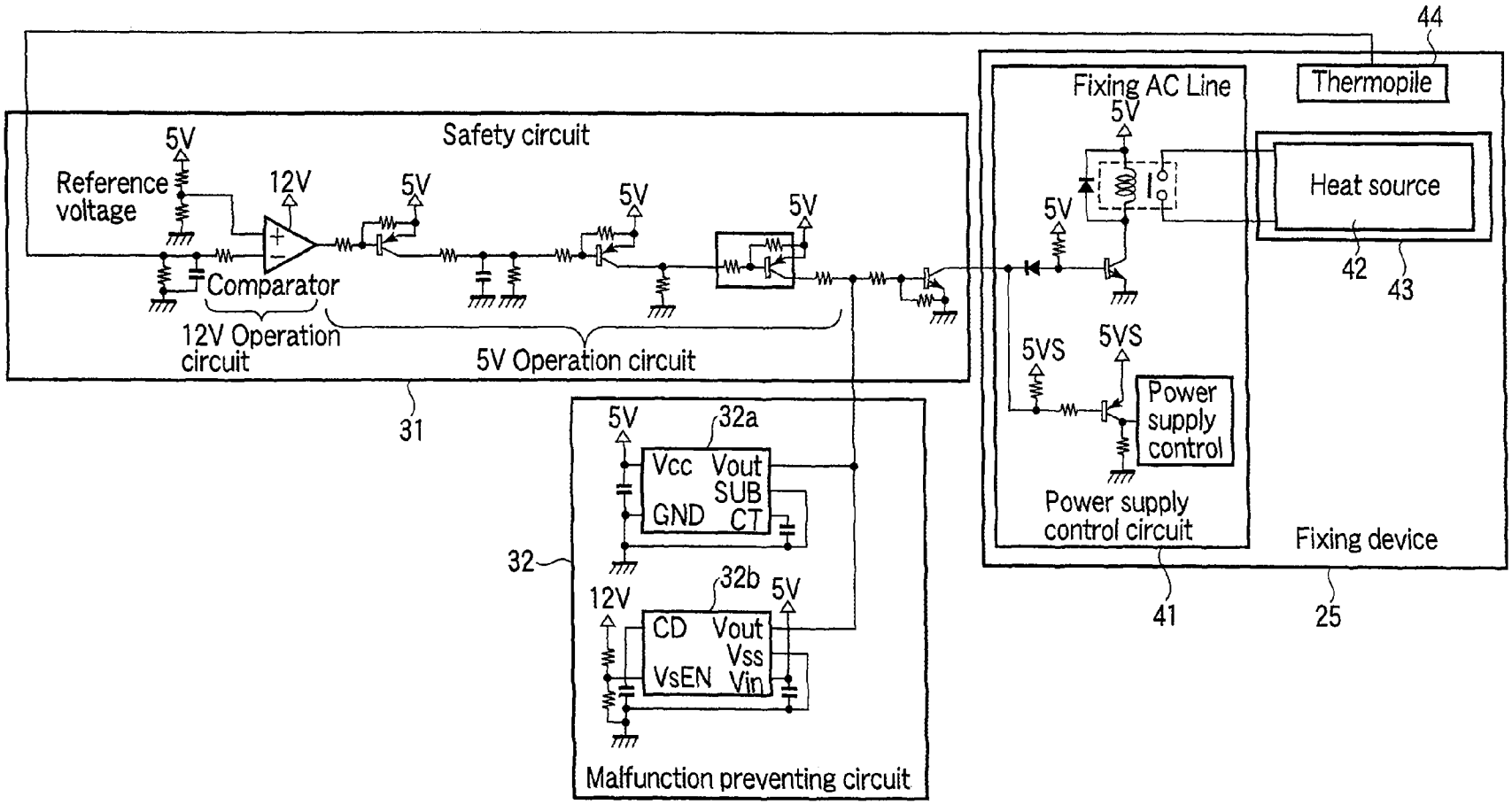
FIG. 2 is a circuit diagram of a configuration example of the fixing device, a safety circuit, and a malfunction preventing circuit.

FIG. 2 is a circuit diagram of a configuration example of the fixing device 25, the safety circuit 31, and the malfunction preventing circuit 32. The fixing device 25, the safety circuit 31, and the malfunction preventing circuit 32, which are shown in FIG. 2 configure the fixing device as a heating device. The circuit having the configuration example shown in FIG. 2 can be applied not only to the fixing device but also to a general heating device having a heat source that generates heat with electric power supplied from a power supply.

As shown in FIG. 2, the safety circuit 31 causes the power supply control circuit 41 in the fixing device 25 to interrupt voltage supply to the heat source 42. The safety circuit 31 performs not only voltage control for the heat source 42 but also control of power supply to the entire printer 17 or the entire digital multifunction peripheral 1. When the safety circuit 31 detects abnormality, the safety circuit 31 interrupts the voltage supply to the heat source 42, the entire printer 17, or the entire digital multifunction peripheral 1.

The safety circuit 31 shown in FIG. 2 includes a 12V-operation circuit that operates in response to 12V power supply voltage and a 5V-operation circuit that operates in response to 5V power supply voltage. In the configuration example of the circuit shown in FIG. 2, the thermopile is 5V-driven. In general, an IC as a comparator has a characteristic that the IC can perform accurate comparison only at a voltage level smaller than a power supply voltage value for driving. Therefore, in a comparator driven by voltage at the same level as the 5V-driven thermopile, output based on accurate temperature detection cannot be obtained. Therefore, in the configuration example shown in FIG. 2, the comparator is 12V-driven. The 12V-driven comparator IC outputs an accurate comparison result between an output voltage value of the thermopile and a reference voltage value.

In the circuit shown in FIG. 2, there are power supply voltages in two systems in the safety circuit 31. Therefore, immediately after the power supply for the entire digital multifunction peripheral 1 or the entire printer 17 is turned off, in the safety circuit 31, it is likely that the 12V power supply voltage falls earlier and the 5V power supply voltage sufficiently remains. In such a state, since there is no guarantee that output of the comparator IC is normal, the safety circuit 31 tends to malfunction.

Figure 3:
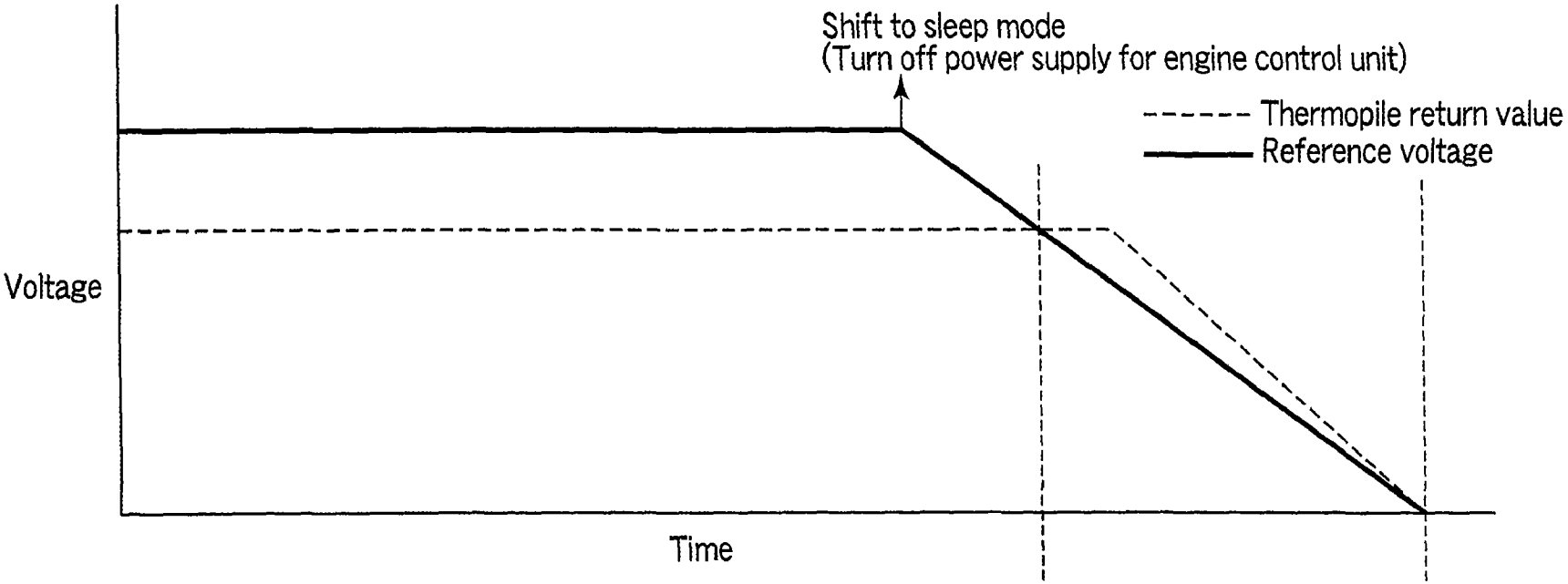
FIG. 3 is a graph of a relation between a reference voltage value and an output value of a thermopile before and after a power supply for a printer is turned off.

FIG. 3 is a graph of a relation between a reference voltage and an output value of the thermopile before and after the power supply for the printer 17 is turned off. The digital multifunction peripheral 1 has an operation mode called sleep mode in order to reduce standby power. In the sleep mode, the power supply for the printer 17 is turned off while the system controller 10 operates with minimum power. In FIG. 3, states before and after an operation mode shifts from a normal mode to the sleep mode are shown.

In an example shown in FIG. 3, before a power supply for the engine control unit 21 is turned off for the shift to the sleep mode, the reference voltage is stable in a state in which the reference voltage value exceeds the output value of the thermopile. This means that temperature detected by the thermopile is equal to or lower than reference temperature and can be normally evaluated. In such a situation, the safety circuit 31 does not forcibly interrupt the voltage supply to the heat source 42, the entire printer 17, and the entire digital multifunction peripheral 1. On the other hand, in the example shown in FIG. 3, after the power supply for the engine control unit 21 is turned off for the shift to the sleep mode, there is a period in which the output value of the thermopile exceeds the reference voltage value. When the output value of the thermopile exceeds the reference voltage value, the safety circuit 31 forcibly interrupts the voltage supply to the heat source 42, the entire printer 17, or the entire digital multifunction peripheral 1. According to the characteristic of the thermopile described above, it is highly likely that a phenomenon in which the output value of the thermopile exceeds the reference voltage value immediately after the power supply for the engine control unit 21 is turned off is not caused by temperature rise in the fixing device 25.

Figure 4:
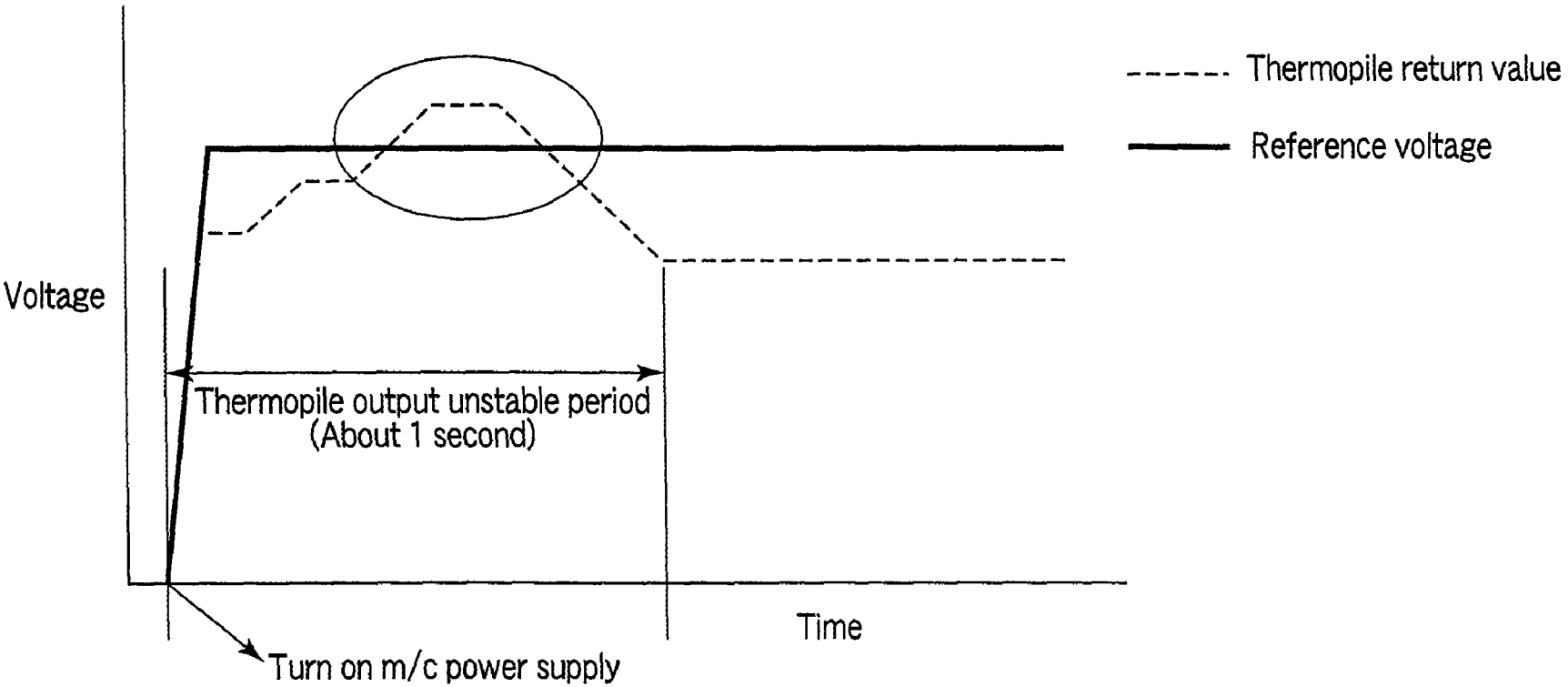

FIG. 4 is a diagram of a relation between the reference voltage value and an output value of the thermopile before and after the power supply for the printer 17 is turned on. In an example shown in FIG. 4, a state in which the output value of the thermopile becomes unstable immediately after the power supply is turned on is shown. This is because power supply voltage is unstable. Even if the power supply voltage becomes unstable in a fixed period immediately after the power supply is turned on, this is not a problem as the operation of the entire digital multifunction peripheral 1 or the entire printer 17. However, when the output value of the thermopile exceeds the reference voltage value even instantaneously, the safety circuit 31 forcibly interrupts the voltage supply to the heat source 42, the entire printer 17, or the entire digital multifunction peripheral 1. As explained above, it is highly likely that the phenomenon in which the output value of the thermopile exceeds the reference voltage value immediately after the power supply is turned on is often caused by voltage fluctuation in plural power supply systems and the characteristic of the thermopile and is not caused by temperature rise in the fixing device 25.

As shown in FIGS. 3 and 4, the operation of the safety circuit 31 is unstable in a period in which the power supply voltage is unstable immediately after the power supply for the engine control unit 21 is turned on or turned off. The safety circuit 31 is a circuit that prevents abnormal operation of the fixing device 25 and secures safety of the entire printer 17 and the entire digital multifunction peripheral 1. Therefore, for the entire printer 17 and the entire digital multifunction peripheral 1, it is necessary to surely prevent malfunction of the safety circuit 31 even immediately after the power supply is turned on or immediately after the shift to the sleep mode.

Therefore, in the configuration example shown in FIG. 2, the malfunction preventing circuit 32 for preventing malfunction of the safety circuit 31 is present. The malfunction preventing circuit 32 invalidates (stops) actions of the safety circuit 31 during a period in which the power supply voltage to the engine control unit 21 is unstable. In the circuit having the configuration example shown in FIG. 2, the safety circuit 31 is brought into an inoperative state by the malfunction preventing circuit 32 during a period in which the power supply voltage is unstable immediately after the power supply for the engine control unit 21 is turned on or turned off. As a result, in the entire circuit shown in FIG. 2, the operation of the safety circuit 31 can be stopped and malfunction of the safety circuit 31 can be prevented during a period in which the power supply voltage is unstable.

The malfunction preventing circuit 32 is explained below.

In the configuration example shown in FIG. 2, the malfunction preventing circuit 32 is connected to a portion in the safety circuit 31 at a pre-stage of connection to the power supply control circuit 41 in the fixing device 25. This is for the purpose of invalidating a signal from the safety circuit 31 with an output signal from the malfunction preventing circuit 32. The malfunction preventing circuit 32 outputs a signal for making the safety circuit 31 inoperative when the power supply voltage is unstable. The malfunction preventing circuit 32 is applicable to all the power supply systems in the safety circuit 31. The malfunction preventing circuit 32 invalidates the operation of the safety circuit 31 until all the power supply systems stabilize.

In the configuration example shown in FIG. 2, the malfunction preventing circuit 32 includes two reset ICs 32*a* and 32*b*. The reset ICs 32*a* and 32*b* corresponds to the various power supply systems in the safety circuit 31. In the configuration example shown in FIG. 2, voltages are supplied to the safety circuit 31 from two power supply systems, i.e., a 5V power supply system and a 12V power supply system. The malfunction preventing circuit 32 shown in FIG. 2 includes the two reset ICs 32*a* and 32*b* corresponding to the two power supply systems in the safety circuit 31.

For example, the reset IC 32*a* corresponds to the 5V power supply. The reset IC 32*a* outputs a signal for invalidating the operation of the safety circuit 31 when the 5V power supply voltage is unstable. The reset IC 32*b* corresponds to the 12V power supply. The reset IC 32*b* outputs a signal for invalidating the operation of the safety circuit 31 when the 12V power supply voltage is unstable. Therefore, the malfunction preventing circuit 32 outputs the signal for invalidating the operation of the safety circuit 31 from any one of the reset ICs 31*a* and 32*b* when any one of the 5V power supply and the 12V power supply is unstable. In other words, the malfunction preventing circuit 32 permits the operation of the safety circuit 31 in a state in which all the power supply systems in the safety circuit 31 are stable.

Power supply control for the fixing device 25 in the digital multifunction peripheral 1 is explained.

Figure 5:
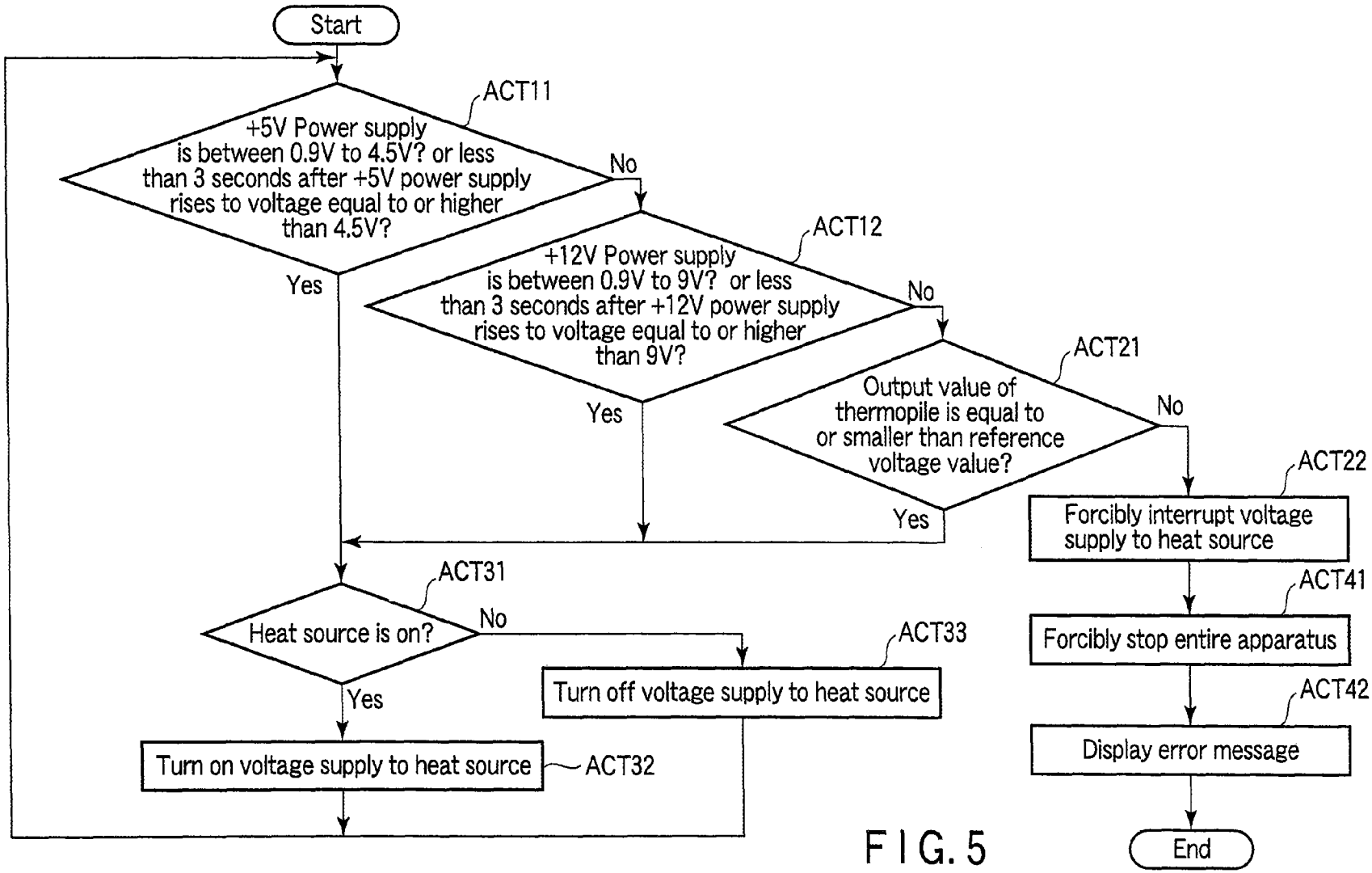
FIG. 5 is a flowchart for explaining a flow of power supply control for the fixing device.

FIG. 5 is a flowchart for explaining a flow of the power supply control for the fixing device 25 by the circuit shown in FIG. 2.

ACT 11 and ACT 12 shown in FIG. 5 are actions by the malfunction preventing circuit 32. ACT 21 and ACT 22 shown in FIG. 5 are actions by the safety circuit 31. ACT 31, ACT 32, and ACT 33 shown in FIG. 5 are actions by the power supply control circuit 41. ACT 41 and ACT 42 shown in FIG. 5 are actions by the engine control unit 21 or the system controller 10.

First, the malfunction preventing circuit 32 determines whether the 5V power supply is in an unstable state using the reset IC 32*a* (ACT 11). When the reset IC 32*a* detects that the 5V power supply is in the unstable state, the reset IC 32*a* outputs a signal for stopping the operation of the safety circuit 31 (ACT 11, YES). In this case, the malfunction preventing circuit 32 stops the operation of the safety circuit 31.

In an example shown in FIG. 5, the 5V power supply is determined as unstable when a voltage value thereof is in a range of 0.9V to 4.5V (a voltage value of the unstable power supply) or until 3 seconds (time required of the power supply to stabilize) elapses after the voltage value exceeds the range of 0.9V to 4.5V (the voltage value of the unstable power supply). The reset IC 32*a* outputs the signal for stopping the operation of the safety circuit 31 when the voltage value of the 5V power supply is in the range of 0.9V to 4.5V or until 3 seconds elapses after the voltage value of the 5V power supply exceeds the range of 0.9V to 4.5V. Set values for determining that the power supply is unstable are values that should be set as appropriate. For example, the range of the voltage value for determining that the power supply is unstable and the time required of the power supply to stabilize are values that should be set as appropriate.

The malfunction preventing circuit 32 determines whether the 12V power supply is in an unstable state using the reset IC 32*b* (ACT 12). When the reset IC 32*b* detects that the 12V power supply is in the unstable state, the reset IC 32*b* outputs a signal for stopping the operation of the safety circuit 31 (ACT 12, YES). In the case, as in the above case, the malfunction preventing circuit 32 stops the operation of the safety circuit 31.

In the example shown in FIG. 5, the 12V power supply is determined as unstable when a voltage value thereof is in a range of 0.9V to 9V (a voltage value of the unstable power supply) or until 3 seconds (time required of the power supply to stabilize) elapses after the voltage value exceeds the range of 0.9V to 9V (the voltage value of the unstable power supply). The reset IC 32*b* outputs the signal for stopping the operation of the safety circuit 31 when the voltage value of the 12V power supply is in the range of 0.9V to 9V or until 3 seconds elapses after the voltage value of the 12V power supply exceeds the range of 0.9V to 9V. Set values for determining that the power supply is unstable are values that should be set as appropriate. For example, the range of the voltage value for determining that the power supply is unstable and the time required of the power supply to stabilize are values that should be set as appropriate.

When the safety circuit 31 is stopped by the malfunction preventing circuit 32, the power supply control circuit 41 controls the supply of the power supply voltage to the heat source 42 according to a control instruction from the engine control unit 21 (ACT 31). When the power supply control circuit 41 is instructed by the engine control unit 21 to turn on the heat source 42 (ACT 31, YES), the power supply control circuit 41 turns on the voltage supply from the power supply to the heat source 42 (ACT 32). When the power supply control circuit 41 is instructed by the engine control unit 21 to turn off the heat source 42 (ACT 31, NO), the power supply control circuit 41 turns off the voltage supply from the power supply to the heat source 42 (ACT 33).

When both the 5V power supply and the 12V power supply are in the stable state, the safety circuit 31 operates according to output from the thermopile 44 in the fixing device 25 without being affected by the malfunction preventing circuit 32. When both the 5V power supply and the 12V power supply are in the stable state (when the malfunction preventing circuit 32 does not output the signal for stopping the operation of the safety circuit 31), the safety circuit 31 determines whether an output value of the thermopile 44 is equal to or lower than the reference voltage value (ACT 21).

When the output value of the thermopile 44 exceeds the reference voltage value (ACT 21, NO), the safety circuit 31 forcibly interrupts the voltage supply to the heat source 42 (ACT 22). In this case, the engine control unit 21 turns off the power supply for the entire printer 17 or the entire digital multifunction peripheral 1 to thereby forcibly stop the entire printer 17 or the entire digital multifunction peripheral 1 (ACT 41). The system controller 10 displays an error message on the control panel 15 (ACT 42). As the error message, the system controller 10 displays, for example, an indication that the printer is forcibly stopped because of temperature abnormality of the fixing device 25 or a request for maintenance by a service person.

When the output value of the thermopile 44 set in the fixing device 25 is equal to or lower than the reference voltage value (ACT 21, YES), the safety circuit 31 does not interrupt the voltage supply to the heat source 42. In this case, the power supply control circuit 41 controls the supply of the power supply voltage to the heat source 42 according to a control instruction from the engine control unit 21. When both the 5V power supply and the 12V power supply are in the stable state, unless the safety circuit 31 detects temperature rise equal to or higher than a reference value in the fixing device 25, the power supply control circuit 41 controls the supply of the power supply voltage to the heat source 42 according to a control instruction from the engine control unit 21 (ACT 31). When the power supply control circuit 41 is instructed by the engine control unit 21 to turn on the heat source 42 (ACT 31, YES), the power supply control circuit 41 turns on the voltage supply from the power supply to the heat source 42 (ACT 32). When the power supply control circuit 41 is instructed by the engine control unit 21 to turn off the heat source 42 (ACT 31, NO), the power supply control circuit 41 turns off the voltage supply from the power supply to the heat source 42 (ACT 33).

As explained above, the digital multifunction peripheral 1 includes the safety circuit 31 that forcibly interrupts the power supply to the heat source 42 according to abnormal temperature rise in the fixing device 25. The digital multifunction peripheral 1 also includes the malfunction preventing circuit 32 that temporarily stops the safety circuit 31 until the voltages of all the power supply systems stabilize immediately after the power supply is turned on or turned off. As a result, even if the power supply temporarily becomes unstable, the fixing device 25 in the digital multifunction peripheral 1 does not malfunction. Safety of the fixing device can be surely secured.

The memory board 29 is explained below.

Figure 6:
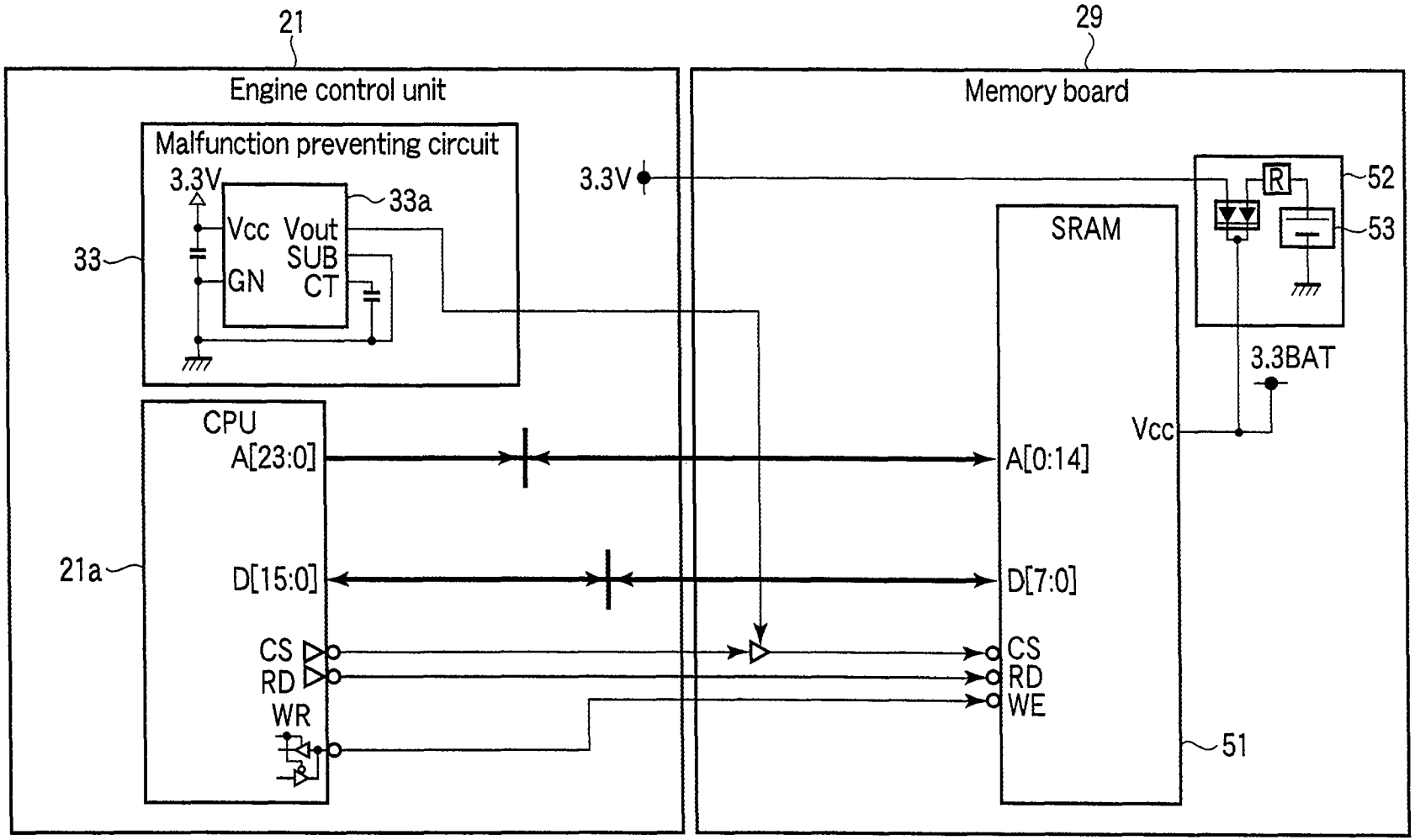
FIG. 6 is a diagram of a configuration example of a memory board and a malfunction preventing circuit.

FIG. 6 is a diagram of a configuration example of the memory board 29 and the malfunction preventing circuit 33. In other words, FIG. 6 is a diagram of a memory control device.

As shown in FIG. 6, the memory board 29 includes an SRAM 51, a driving circuit 52, and a battery 53. The SRAM 51 is a volatile memory. When electric power is supplied to the engine control unit 21, the driving circuit 52 supplies a driving voltage from a 3.3V power supply of the engine control unit 21 to the SRAM 51. When electric power is not supplied to the engine control unit 21, the driving circuit 52 supplies voltage for retaining data from the battery 53 to the SRAM 51.

The SRAM 51 is driven by voltage from the power supply in the engine control unit 21 given via the driving circuit 52. For example, the SRAM 51 writes and reads out data with the voltage given via the driving circuit 52. The SRAM 51 retains stored data with voltage always supplied from the battery 53. For example, even if the power supply in the engine control unit 21 is in the off state, the SRAM 51 retains data with the voltage always supplied from the battery 53. The SRAM 51 stores important data necessary for the operation of the printer 17. For example, the SRAM 51 stores various setting data necessary for the operation of the printer 17 or data indicating a state of the printer 17 such as a cumulative number of prints.

The memory board 29 includes plural signal lines connected to the SRAM 51. The SRAM 51 is connected to a CPU 21*a* serving as a control element in the engine control unit 21 by the plural signal lines. The CPU 21*a* and the SRAM 51 are connected by, for example, an address bus for address control and a data bus for data transfer. The CPU 21*a* designates an address in the SRAM 51 in a driven state via the address bus. The CPU 21*a* writes data transferred via the data bus in the SRAM 51 in the driven state. The CPU 21*a* reads out the data from the SRAM 51 in the driven state via the data bus.

The SRAM 51 includes plural interfaces for operation control (e.g., CS, RD, and WE terminals). The CS terminal is an interface through which a signal for designating validity or invalidity of data writing is input to the SRAM 51. When the signal input to the CS terminal is a valid signal, the SRAM 51 permits writing of data in a memory area. On the other hand, when the signal input to the CS terminal is an invalid signal (an disable signal), the SRAM 51 inhibits writing of data in the memory area.

The malfunction preventing circuit 33 is explained below.

As shown in FIG. 6, the malfunction preventing circuit 33 prevents malfunction of the SRAM 51 on the memory board 29. The malfunction preventing circuit 33 includes a reset IC 33*a*. In the configuration example shown in FIG. 6, the malfunction preventing circuit 33 is connected such that output from the reset IC 33*a* is input to the CS terminal of the SRAM 51. This means that the SRAM 51 can be set in a data write inhibited state by an disable signal from the malfunction preventing circuit 33.

In the malfunction preventing circuit 33, the reset IC 33*a* corresponds to power supply voltage of a power supply system for driving the SRAM 51 in the memory board 29. In the configuration example shown in FIG. 6, driving voltage from a 3.3V power supply system is supplied to the SRAM 51. Therefore, the malfunction preventing circuit 33 shown in FIG. 6 includes the reset IC 33*a* corresponding to the power supply of 3.3V as the driving voltage for the SRAM 51. When the power supply voltage of 3.3V is unstable, the reset IC 33*a* outputs the disable signal for inhibiting data writing to the SRAM 51.

In other words, while the driving voltage (the power supply of 3.3V) for the SRAM 51 is unstable, the malfunction preventing circuit 33 inhibits data writing in the SRAM 51 using the reset IC 33*a*. As a result, the malfunction preventing circuit 33 eliminates the likelihood that the SRAM 51 malfunctions even if the power supply voltage temporarily becomes unstable, for example, immediately after the power supply is turned on or turned off.

A condition for the reset IC 33*a* to output the disable signal (i.e., a set value for determining that power supply voltage for driving the SRAM 51 is unstable) is a value that should be set as appropriate. For example, as a condition for the reset IC 33*a* to output the disable signal, a range of a voltage value for determining that the 3.3V power supply is unstable (e.g., 0.5V to 2.5V) is set as appropriate. As a condition for the reset IC 33*a* to output the disable signal, time required until a voltage value of a power supply for driving stabilizes after exceeding a range in which the power supply is determined as unstable (e.g., 3 seconds) is also set as appropriate.

As explained above, the printer of the digital multifunction peripheral includes the memory control device including the volatile memory that retains data with the battery and the malfunction preventing circuit that prevents malfunction of the volatile memory. When the power supply voltage for driving the volatile memory is unstable, for example, immediately after the power supply is turned on or turned off, the malfunction preventing circuit inhibits data writing in the volatile memory until the power supply voltage stabilizes. As a result, in the memory board used in the digital multifunction peripheral, even if the power supply voltage temporarily becomes unstable, the memory does not malfunction. Therefore, it is possible to surely guarantee safety of the data.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A heating device comprising:

a heat source that converts electric power into heat;

a power supply control circuit that supplies voltage from a power supply to the heat source;

a sensor that detects ambient temperature of the heat source;

a safety circuit that forcibly interrupts the voltage supplied to the heat source by the power supply control circuit if the temperature detected by the sensor exceeds reference temperature; and a malfunction preventing circuit that stops operation of the safety circuit when voltage supplied to the safety circuit is unstable.

2. The device according to claim 1, wherein the malfunction preventing circuit stops the operation of the safety circuit until the voltage supplied to the safety circuit stabilizes after a power supply for the device is turned on.

3. The device according to claim 1, wherein the malfunction preventing circuit stops the operation of the safety circuit until the voltage supplied to the safety circuit stabilizes after the power supply for the device is turned off.

4. The device according to claim 1, wherein the malfunction preventing circuit includes a reset IC that outputs a signal for stopping the operation of the safety circuit while the voltage supplied to the safety circuit is unstable.

5. The device according to claim 1, wherein, if plural power supplies having different voltage values are present in the safety circuit, the malfunction preventing circuit includes plural reset ICs corresponding to the respective voltage values of the plural power supplies and outputs a signal for stopping the operation of the safety circuit until voltages from all the power supplies stabilize.

6. The device according to claim 1, wherein the device includes, as power supplies for supplying voltage to the safety circuit, a first power supply and a second power supply having a voltage value different from that of the first power supply, the safety circuit includes a circuit that operates according to voltage supplied from the first power supply and a circuit that operates according to voltage supplied from the second power supply, and the malfunction preventing circuit includes a first reset IC corresponding to the first power supply and a second reset IC corresponding to the second power supply and, if the voltage from the first power supply is unstable or if the voltage from the second power supply is unstable, outputs a signal for stopping the operation of the safety circuit.

7. The device according to claim 1, wherein the sensor is a thermopile that outputs a voltage value corresponding to the detected temperature, and the safety circuit outputs a signal for interrupting the voltage supplied to the heat source if the voltage value output from the thermopile is equal to or larger than a reference voltage value.

8. The device according to claim 1, wherein the sensor is a thermistor that outputs a voltage value corresponding to the detected temperature, and the safety circuit outputs a signal for interrupting the voltage supplied to the heat source if the voltage value output from the thermistor is equal to or larger than a reference voltage value.

9. A fixing device that fixes a toner image on a recording medium, the fixing device comprising:

a heat source that converts electric power into heat;

a fixing member that fixes the toner image on the recording medium with the heat generated by the heat source;

a power supply control circuit that supplies voltage from a power supply to the heat source;

a sensor that detects temperature in the device;

a safety circuit that forcibly interrupts the voltage supplied to the heat source by the power supply control circuit if the temperature detected by the sensor exceeds reference temperature; and a malfunction preventing circuit that stops operation of the safety circuit when voltage supplied to the safety circuit is unstable.

10. The device according to claim 9, wherein the malfunction preventing circuit stops the operation of the safety circuit until the voltage supplied to the safety circuit stabilizes after a power supply for the device is turned on.

11. The device according to claim 9, wherein the malfunction preventing circuit stops the operation of the safety circuit until the voltage supplied to the safety circuit stabilizes after the power supply for the device is turned off.

12. The device according to claim 9, wherein the malfunction preventing circuit includes a reset IC that outputs a signal for stopping the operation of the safety circuit while the voltage supplied to the safety circuit is unstable.

13. The device according to claim 9, wherein, if plural power supplies having different voltage values are present in the safety circuit, the malfunction preventing circuit includes plural reset ICs corresponding to the respective voltage values of the plural power supplies and outputs a signal for stopping the operation of the safety circuit until voltages from all the power supplies stabilize.

14. The device according to claim 9, wherein the device includes, as power supplies for supplying voltage to the safety circuit, a first power supply and a second power supply having a voltage value different from that of the first power supply, the safety circuit includes a circuit that operates according to voltage supplied from the first power supply and a circuit that operates according to voltage supplied from the second power supply, and the malfunction preventing circuit includes a first reset IC corresponding to the first power supply and a second reset IC corresponding to the second power supply and, if the voltage from the first power supply is unstable or if the voltage from the second power supply is unstable, outputs a signal for stopping the operation of the safety circuit.

15. The device according to claim 9, wherein the sensor is a thermopile that outputs a voltage value corresponding to the detected temperature, and the safety circuit outputs a signal for interrupting the voltage supplied to the heat source to the power supply control circuit if the voltage value output from the thermopile is equal to or larger than a reference voltage value.

16. The device according to claim 9, wherein the sensor is a thermistor that outputs a voltage value corresponding to the detected temperature, and the safety circuit outputs a signal for interrupting the voltage supplied to the heat source to the power supply control circuit if the voltage value output from the thermistor is equal to or larger than a reference voltage value.

17. A memory control device comprising:

a volatile memory driven by voltage supplied from a power supply;

a battery for retaining data to be stored in the volatile memory;

a control unit that writes data in the volatile memory driven by the voltage supplied from the power supply; and a malfunction preventing circuit that outputs an disable signal for inhibiting the writing of the data in the volatile memory when the driving voltage supplied to the volatile memory is unstable.

18. The device according to claim 17, wherein the malfunction preventing circuit outputs the disable signal while the voltage supplied from the power supply is unstable after the power supply for supplying the driving voltage to the volatile memory is turned off.

19. The device according to claim 18, wherein the malfunction preventing circuit outputs the disable signal while the voltage supplied from the power supply is unstable after the power supply for supplying the driving voltage to the volatile memory is turned on.

20. The device according to claim 17, wherein the malfunction preventing circuit includes a reset IC that outputs the disable signal if the driving voltage supplied to the volatile memory is unstable.

* * * * *